US005815134A

United States Patent [19]

Nishi

[11] Patent Number: 5,815,134

[45] Date of Patent: Sep. 29, 1998

[54] LIQUID CRYSTAL ELECTRO-OPTICAL DEVICE AND DRIVING METHOD THEREOF

[75] Inventor: Takeshi Nishi, Kanagawa, Japan

[73] Assignee: Semiconductor Energy Laboratory Co., Ltd., Japan

[21] Appl. No.: 436,864

[22] Filed: May 8, 1995

[30] Foreign Application Priority Data

May 16, 1994 [JP] Japan ..... 6-126804

[51] Int. Cl.[6] ..... G09G 3/36

[52] U.S. Cl. ..... 345/97; 345/87; 345/95; 345/94

[58] Field of Search ..... 345/94, 95, 87, 345/97, 101

[56] References Cited

U.S. PATENT DOCUMENTS 4,242,679 12/1980 Morozumi et al. ..... 345/208
4,621,260 11/1986 Suzuki et al. ..... 345/94
5,280,280 1/1994 Hotto ..... 345/94
5,287,205 2/1994 Yamazaki et al. ..... 345/94

*Primary Examiner*—Richard A. Hjerpe
*Assistant Examiner*—Kent C. Lang
*Attorney, Agent, or Firm*—Sixbey, Friedman, Leedom & Ferguson; Gerald J. Ferguson, Jr.; Jeffrey L. Costellia

[57] ABSTRACT

A liquid crystal electro-optical device has a first substrate on which a plurality of pixel electrodes to which thin-film transistors are connected are arranged in matrix form, a second substrate opposed to the first substrate and provided with an opposed electrode, and a ferroelectric or antiferroelectric liquid crystal material provided between the first and second substrates. A voltage value between a selected one of the pixel electrodes and the opposed electrode is detected, and a voltage value corresponding to the detected voltage value is applied to the selected pixel electrode.

21 Claims, 7 Drawing Sheets

△ : conventional driving method

○ : present invention

LIQUID CRYSTAL ELECTRO-OPTICAL DEVICE AND DRIVING METHOD THEREOF

BACKGROUND OF THE INVENTION

The present invention relates to a driving method of a liquid crystal electro-optical device which employs thin-film transistors as switching elements for driving and a ferroelectric or antiferroelectric liquid crystal. More specifically, the invention relates to a driving method for realizing gradational display by optically controlling light and dark periods in a gradation display method for obtaining halftone color or gray scale expressions.

In recent years, liquid crystal electro-optical devices using a ferroelectric or antiferroelectric liquid crystal have been studied extensively. Among those, surface-stabilized liquid crystal electro-optical devices in which the interval between substrates accommodating a liquid crystal is made as narrow as several micrometers to release the helical structure of liquid crystal molecules now attract much attention because of their superior characteristics such as high response speed and bistable performance.

Exhibiting bistable performance, surface-stabilized liquid crystal electro-optical devices using a ferroelectric or antiferroelectric liquid crystal mostly perform a display in terms of two states, i.e. light and dark states.

However, to perform grey scale display or halftone color display, it is necessary to provide an arbitrary intermediate display state between the light and dark states, i.e., to enable gradational display.

There are several methods for performing gradational display in a surface-stabilized liquid crystal electro-optical device using a ferroelectric or antiferroelectric liquid crystal. Examples of those methods are as follows.

(1) Controlling the areas of an inverted region and a noninverted region of a domain by changing an application voltage.

(2) Constructing a pixel block by a plurality of pixels, and causing a light-display portion and a dark-display portion of the pixel block to operate at the same time in accordance with a desired number of gradation levels.

However, in method (1), it is extremely difficult to control the application voltage. Method (2) has problems that to increase the number of gradation levels, the resolution of display needs to be lowered and the device structure including electrodes etc. should be made very fine, which causes difficulties in its manufacture. Thus, method (2) cannot provide so large number of gradation levels as expected.

Further, there is known another gradational display method generally called a frame gradation method.

In a display device, display is generally performed such that several tens of frames (images), say, 30 frames are displayed per one second.

Usually, each frame is displayed by scanning a scanning line by line from its top. For example, in the case of a matrix of 640×480 pixels, to display a first frame, signals are first applied to 640 pixels of the first line, signals are then applied to 640 pixels of the second line, and so forth. The display of the first frame is completed when the bottom line, i.e., the 480th line is drawn. Display of a second frame is thereafter started with scanning of the first line.

By further increasing the number of frames, gradational display can be realized in a simulated manner by virtue of the afterimage phenomenon even though two-state display (light and dark) is performed in each frame.

For example, one frame is constructed by two subframes and the number of frames are set at 30/sec, in which case each subframe is displayed in 1/60 sec. In such a case, two states (two gradation levels) of light and dark are obtained by the first subframe. When it is combined with the second subframe which is also associated with two states, three gradation levels, i.e., light, intermediate between light and dark, and dark, can be obtained.

The above type of gradational display method is called the frame gradation method. In this method, gradational display is performed by controlling the period in which the light or dark state is effected. The number of subframes required is the number of gradation levels minus one. That is, 31 subframes are needed to perform 32-gradation display.

A Japanese patent Laid-open No. 6-82756 (Mar. 25, 1994) discloses a display scheme according to the frame gradation method in which scheme the display periods of respective subframes constituting one frame are a series of n-th powers of 2, i.e., 1, 2, 4, 8, . . . where the minimum unit period is assumed to be 1. This scheme can provide a relatively large number of gradation levels even with a very small number of subframes.

For example, 32-gradation display can be realized by preparing 5 subframes having respective display periods of 16 units, 8 units, 4 units, 2 units and 1 unit and constituting one frame by a combination of these five subframes.

There are various methods of combining the subframes. FIG. 1 shows an example of combining the subframes. In this examples, the subframes are arranged in the order of 1 unit, 16 units, 2 units, 8 units and 4 units in one frame. FIG. 1 shows light and dark periods of each of gradation levels 0–31, where solid lines indicate a light (or transparent) state and dashed lines indicate a dark (or non-transparent) state.

According to this scheme, driving processing becomes very easy, and the frame gradation display can be performed easily and positively.

To provide better optical characteristics in the above scheme, a Japanese patent application No. 5-347676 discloses a driving method in which relationships between the amount of charge to be injected into display pixels in the gradation display and the components and factors of a display device such as a liquid crystal material used in a liquid crystal electro-optical device and the shape of display pixels.

According to the above frame gradation methods, by constituting switching elements of a liquid crystal material by thin-film transistors, driving can be effected even if the width of driving voltage pulses to be applied for switching is less than several microseconds, which is even shorter than a short response time of a ferroelectric or antiferroelectric liquid crystal. Thus, multi-gradational display can be performed more effectively.

The above frame gradation methods can clearly express differences between individual gradation levels in the case where the number of gradation levels are not large. For example, it was confirmed that good gradational display was performed when a plurality of vertical stripes were displayed on a screen and the gradation level was increased (from dark to light) from left to right. However, in a certain large number of gradation levels, a difference between adjacent gradation levels became unclear. For example, in a 32-gradation display, the first gradation level (i.e., darkest level) and the second gradation level (i.e., the second darkest level) showed almost the same transmittance.

To study the cause of the above phenomenon, the relationship between the driving waveform and the optical response of the display device was checked for a single pixel. It was found that in a portion where a desired gradation level is not obtained, intended transmittances were not attained. More specifically, a subframe of a light state had a transmittance that was smaller than a desired value while a subframe of a dark state had a transmittance that was larger than a desired value. This phenomenon appears when one of the light and dark display states are continued and immediately thereafter the other display state is effected.

This phenomenon is explained as follows in terms of the balance (income/outgo) of charges in each pixel. When one display state (for instance, light state) is continued particular times, that is, when a voltage of the same polarity continues to be applied even after completion of switching a liquid crystal material, a pixel is supplied with extra charges in addition to charges that are required to switch the liquid crystal material. Therefore, when the other display state (for instance, dark state) is thereafter effected, a part of charges that are injected by a voltage of the other polarity is canceled out by the above extra charges, so that liquid crystal molecules are inverted insufficiently, which means an insufficient light or dark state. As the number of gradation levels is increased, the pulse width of the application voltage is shortened and therefore the amount of charges injected into each pixel during a subframe is decreased. As a result, it becomes more difficult to inject charges enough to cancel out the excessive charges, making a faulty optical response more remarkable.

SUMMARY OF THE INVENTION

An object of the present invention is to provide a liquid crystal electro-optical device and its driving method which can attain a desired degree of gradation in realizing gradational display by optically controlling light and dark periods in a gradational display method for obtaining halftone color or gray scale expressions in a liquid crystal display device which employs thin-film transistors as switching elements for driving and a ferroelectric or antiferroelectric liquid crystal.

To attain the above object, according to the invention, a liquid crystal electro-optical device comprises:

- a first substrate having a plurality of pixel electrodes formed thereon in a matrix form, said pixel electrodes provided with thin-film transistors connected thereto;
- a second substrate opposed to the first substrate and provided with an opposed electrode;
- a ferroelectric or antiferroelectric liquid crystal material provided between the first and second substrates; and
- means for detecting a voltage value between a selected one of the pixel electrodes and the opposed electrode.

The application of the voltage across the liquid crystal material at each pixel and the detection of the voltage applied thereto may be conducted through the opposed electrode and the corresponding pixel electrode. In accordance with the detected voltage value, a next voltage which is to be applied to the pixel electrode is controlled. For example, the next voltage may be so set as to be smaller than and have the same polarity as the detected voltage when a next display state is the same as the current display state, and be larger than and have a polarity opposite to that of the detected voltage when the next display state is different from the current display state.

A memory may be provided to the device, if desired, for temporarily storing the detected voltage.

Further, a method for driving the electro-optical device in accordance with a preferred embodiment of the present invention, one frame is constituted of a plurality of subframes so that a gradational display can be performed by controlling light and dark display periods of each pixel. Further, a width of drive pulses is shorter than a response time of the liquid crystal material.

In accordance with the present invention, first, the voltage value (hereinafter called a pixel voltage value) between the pixel electrode and the opposed electrode of a selected pixel that is in a display state of a light (or transparent) state or a dark (or non-transparent) state is detected.

(1) If the next display state (light or dark) is the same as the current display state, for example, if a selected pixel currently in a light state has the next display state that is also a light state, a pixel voltage value that is smaller than and has the same polarity as the detected pixel voltage value is applied to the pixel electrode.

(2) If the next display state is different from the current display state, for example, if a selected pixel currently in a light state has a dark state as the next display state, a pixel voltage value that is larger than and has a polarity opposite to that of the detected pixel voltage value is applied to the pixel electrode.

With the above operation, when the display state transfers from one state (light or dark) that has continued for a long time to the other state, charge storage due to consecutive subframes of the same polarity can be reduced, and a voltage value large enough to enable successful transfer to the display state of the other polarity can be applied. Either of operations (1) and (2) may be performed after the detection of the pixel voltage value.

To detect the pixel voltage value, an electrode for that purpose may be provided separately. Alternatively, the pixel electrode and the opposed electrode may serve as the electrodes for the pixel voltage value detection as well as the electrodes for the voltage application.

It is preferred that the pixel voltage value be detected in a pixel selection period in which a particular pixel is selected and a voltage is applied to the gate electrode to turn on a thin-film transistor, and then a voltage corresponding to the detected pixel voltage value be applied to the pixel electrode. In this operation, the detected voltage value may be stored temporarily.

In accordance with a preferred embodiment of the present invention, a circuit comprising a transistor and an operational amplifier can be used to output a voltage which is in accordance with the detected pixel voltage value.

With the constitution of the invention, in frame gradational display, switching between the light and dark states can be performed definitely to provide desired gradational display.

DESCRIPTION OF THE PREFERRED EMBODIMENT

A preferred embodiment of the present invention will be hereinafter described.

Figure 2:
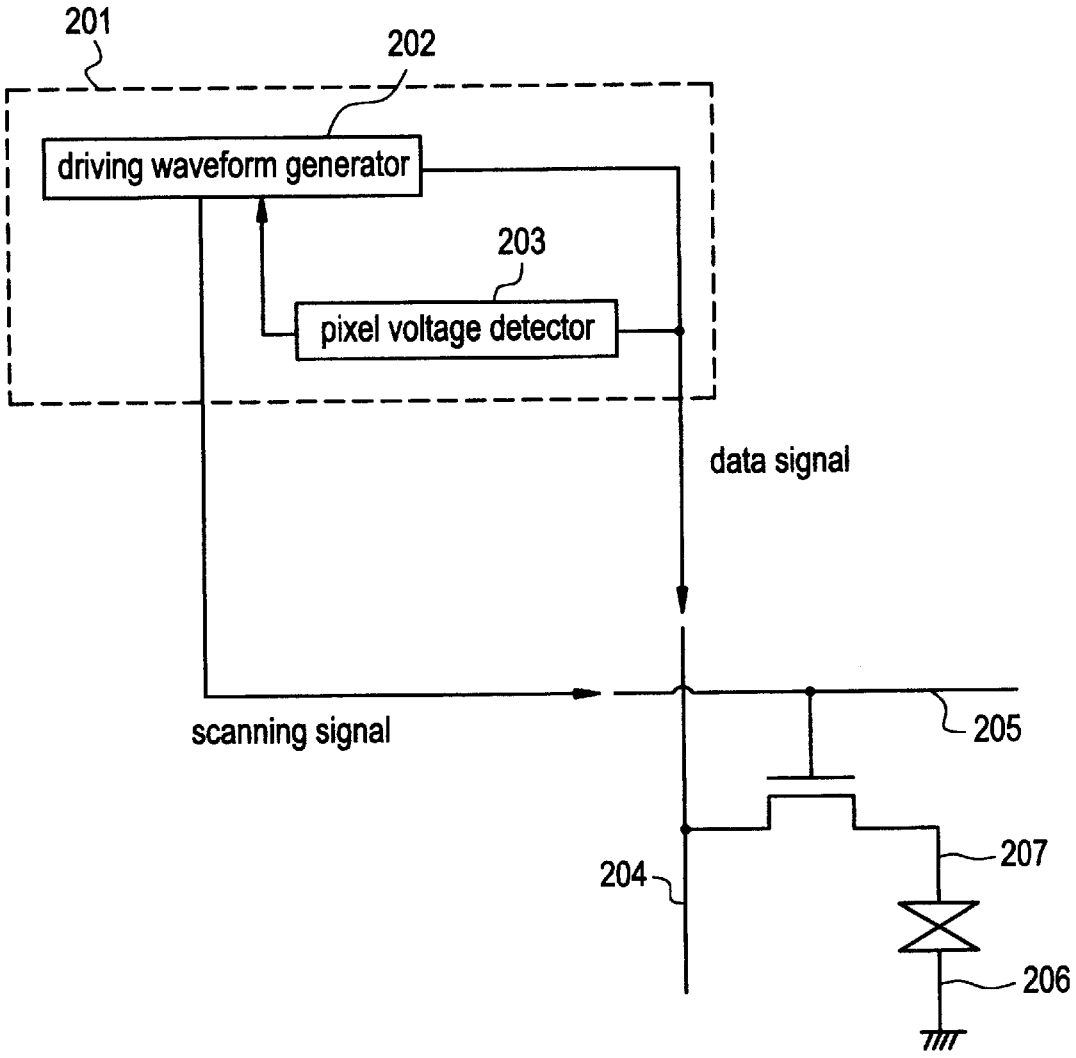
FIG. 2 shows a driving circuit (basic configuration) of an embodiment of the present invention and an equivalent circuit of a pixel of a display device and a switching element therefor.

FIG. 2 shows a driving circuit (basic configuration) of this embodiment and an equivalent circuit of a pixel of a display device and a switching element therefor.

Referring to FIG. 2, the basic configuration of the driving circuit, which is shown in the inside (indicated by numeral 201) of a broken line rectangle, generally consists of a driving waveform generator 202 for supplying driving waveforms to a signal electrode 204, a scanning electrode 205, and a pixel electrode 207, and pixel voltage detecting section 203 for detecting a pixel electrode voltage value with respect to an opposed electrode 206. Information (current, voltage, or the like) relating to the pixel voltage is output from the pixel voltage detecting section 203 and fed back to the driving waveform generator 202.

If the driving circuit is so adapted that a circuit for the pixel voltage detection and feedback is provided downstream of the data signal output stage, it becomes possible to perform gradational display of a larger number of gradation levels while using the driving circuit itself of the conventional active matrix type liquid crystal electro-optical device.

In the driving method of this embodiment, one circuit for pixel voltage detection is needed for one signal electrode; that is, a large number of circuits for pixel voltage detection need to be formed for many pixels. In practice, to reduce the size of the driving circuit, it is desired that the circuits for pixel voltage detection be formed as an integrated circuit. To this end, the circuit for pixel voltage detection should have a simple circuit configuration, which is easily realized by using an operational amplifier.

Further, if a transistor is used as a feedback resistor of the operational amplifier, the amplification factor of the operational amplifier can be varied automatically in accordance with the pixel voltage, which contributes to simplification of the circuit. In this embodiment, there will be described below a combination of a transistor and an operational amplifier as a means for detecting the pixel voltage and producing a drive pulse having a voltage value that corresponds to the detected pixel voltage.

For example, where an FET is used as a feedback resistor of an operational amplifier, its drain and source are connected to the operational amplifier and its gate is connected to either pixel electrode. When the pixel voltage is increased, the drain-source resistance decreases (i.e., the drain-source current increases) and the feedback resistance of the operational amplifier decreases. As a result, the amplification factor of the operational amplifier decreases, to effect control of reducing the voltage value applied between the pixel electrode and the opposed electrode in the next subframe. Conversely, when the pixel voltage is reduced, the amplification factor of the operational amplifier increases, to produce an increased application voltage value.

Therefore, with the above circuit configuration, there occurs no insufficiency in the amount of charge supplied to a display pixel and therefore the optical response does not depend on the subframe periods anymore. It becomes possible to realize display of a desired number of gradation levels.

In this embodiment, the voltage value between the pixel electrode and the opposed electrode is detected only during selection periods. Therefore, in principle, there will appear no influence of the voltage value detection during non-selection periods, to cause no deterioration in display performance.

A description will be made of an example for driving a liquid crystal electro-optical device using the above circuit configuration.

(1) Basic configuration of driving circuit and control method

In the driving circuit of this embodiment, the circuit of generating the data signal, scanning signal and pixel signal is basically the same as in the driving circuit of the conventional liquid crystal electro-optical device. However, the circuit of detecting the pixel voltage and supplying a corresponding voltage value to the pixel electrode is specific to this embodiment, which circuit is exemplified in FIG. 3. An operational amplifier and an FET are used in this circuit (indicated by numeral 301). A control method is as follows.

Figure 7:
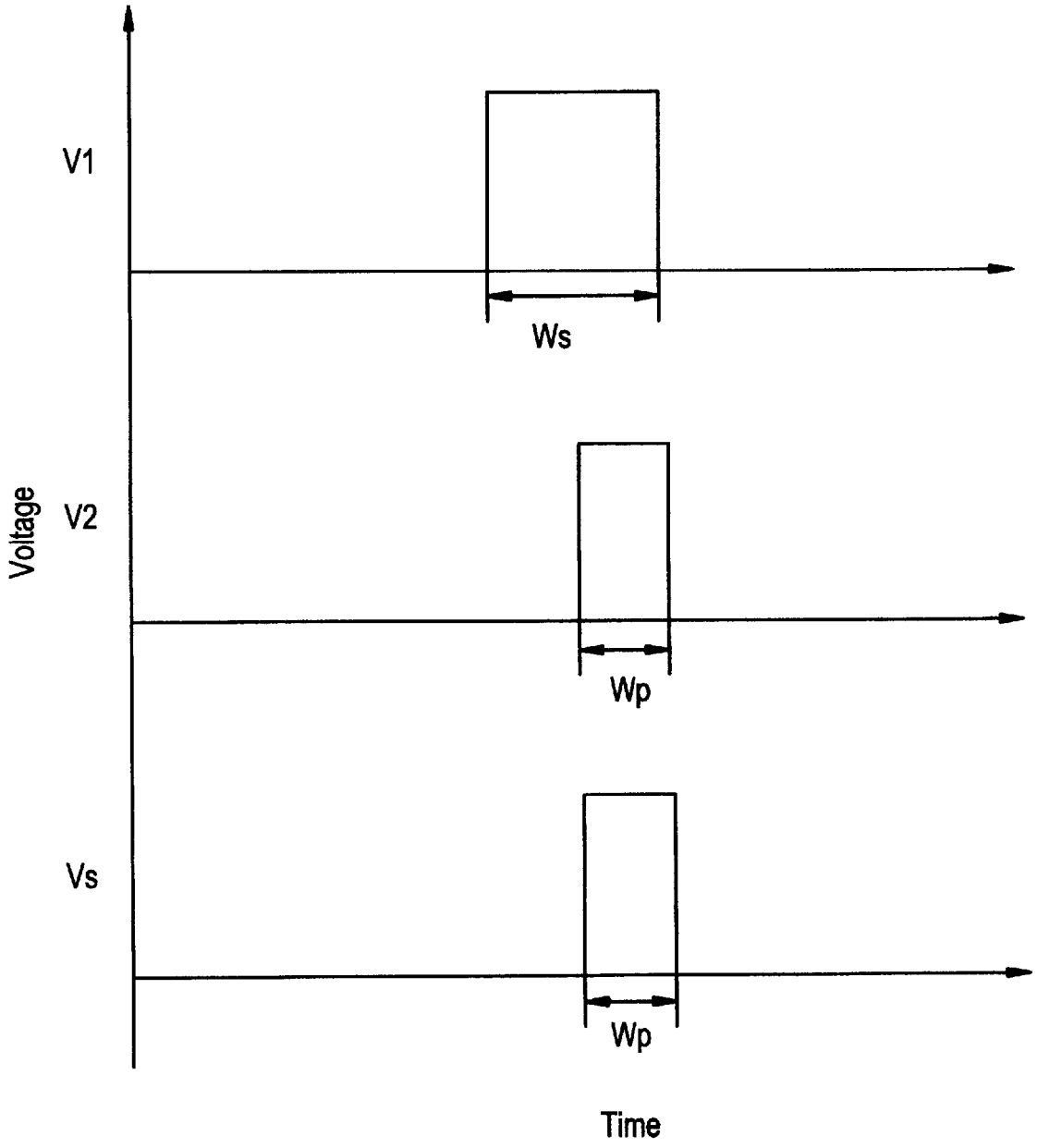
FIG. 7 shows a timing chart of pulses for detecting a pixel electrode voltage and for outputing a signal voltage during one selection period.

FIG. 7 shows a timing chart of a voltage measuring period $W_s$ and a driving pulse output period $W_p$ within a selection period. The data signal applied to a pixel consists of a pulse having a voltage which depends upon the detected voltage of the pixel. The driving waveform generator 202 outputs timing pulses having the pulse durations $W_s$ and $W_p$ to gates of FETs 302 and 304 shown in FIG. 3, respectively. Initially, during the period $W_s$, the FET 302 is maintained its ON state so that charges are supplied to the gate of FET 303 from the pixel electrode. Therefore, the source-drain resistance RTR changes depending upon the pixel electrode voltage.

Figure 3:
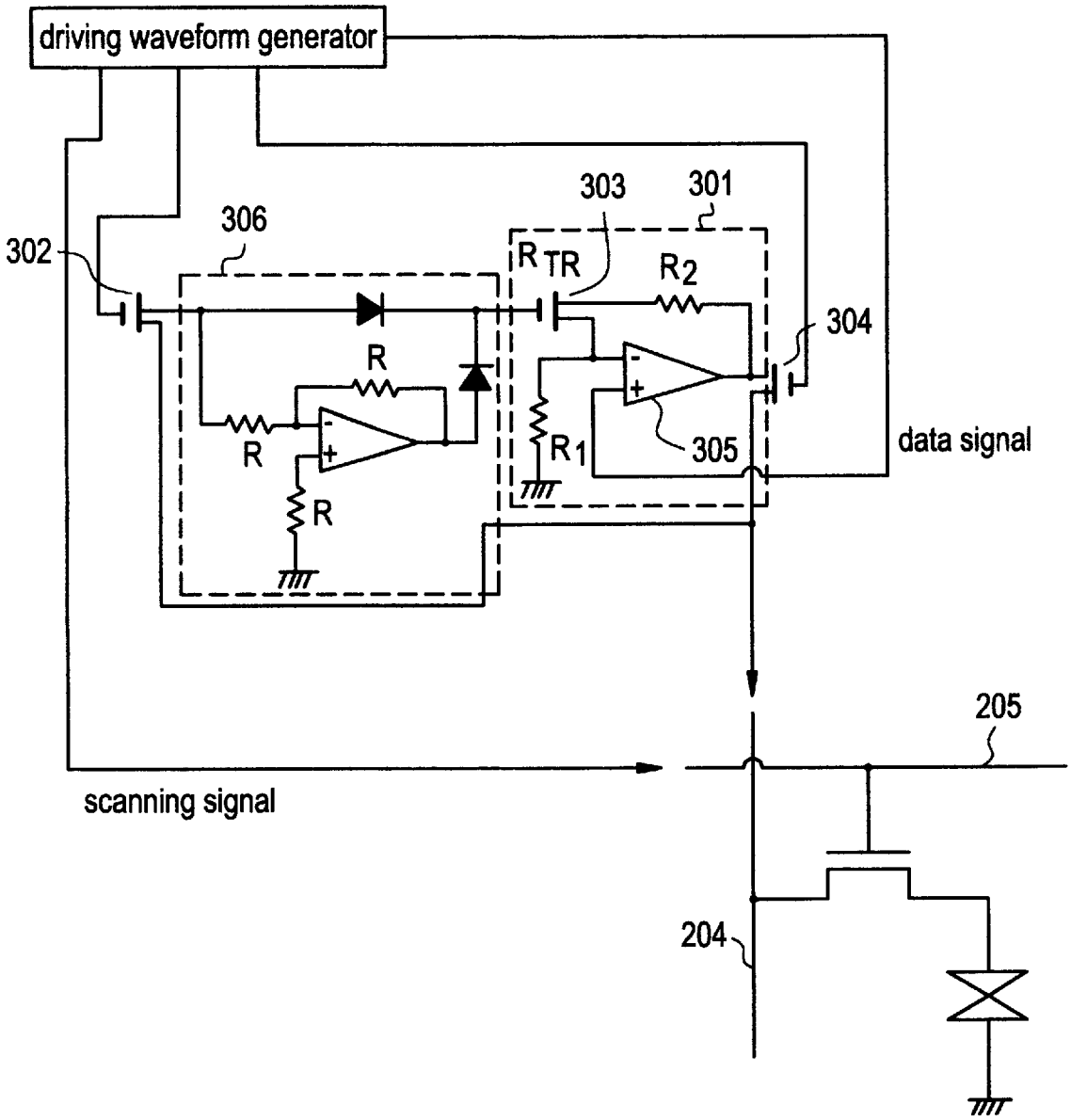
FIG. 3 shows an example of a circuit for detecting a pixel voltage and supplying a corresponding voltage value to a pixel electrode.

In the circuit of the present embodiment, the amplitude ANF of the operational amplifier 305 is expressed by the equation:

$A_{NF}=1+(R_{TR}+R_2)/R_1$, wherein $R_1$, $R_2$ and $R_{TR}$ is the resistance value of the respective resistors shown in FIG. 3.

In this way, the amplitude ANF of the operational amplifier 305 is varied depending upon the voltage of the pixel electrode.

Next, during the period $W_p$, a timing pulse for outputing a driving pulse is output from the driving waveform generator to the gate of FET 304 to turn the transistor on, a driving pulse having a controlled voltage is output.

Although the polarity of the output from the source of the FET 302 depends upon the polarity of the voltage of the pixel electrode, the polarity of the voltage applied to the gate of the FET 303 must be always positive, otherwise, it is not possible to control the driving waveform depending upon the pixel electrode when the polarity of the pixel electrode voltage is negative. For this reason, a circuit 306 composed of an operational amplifier and diodes is provided so that the polarity of the voltage to the gate of the FET 303 can be always maintained positive.

Although field-effect transistors are used in this embodiment, no problem occurs even with bipolar transistors.

(2) Configuration of liquid crystal electro-optical device

Figure 4:
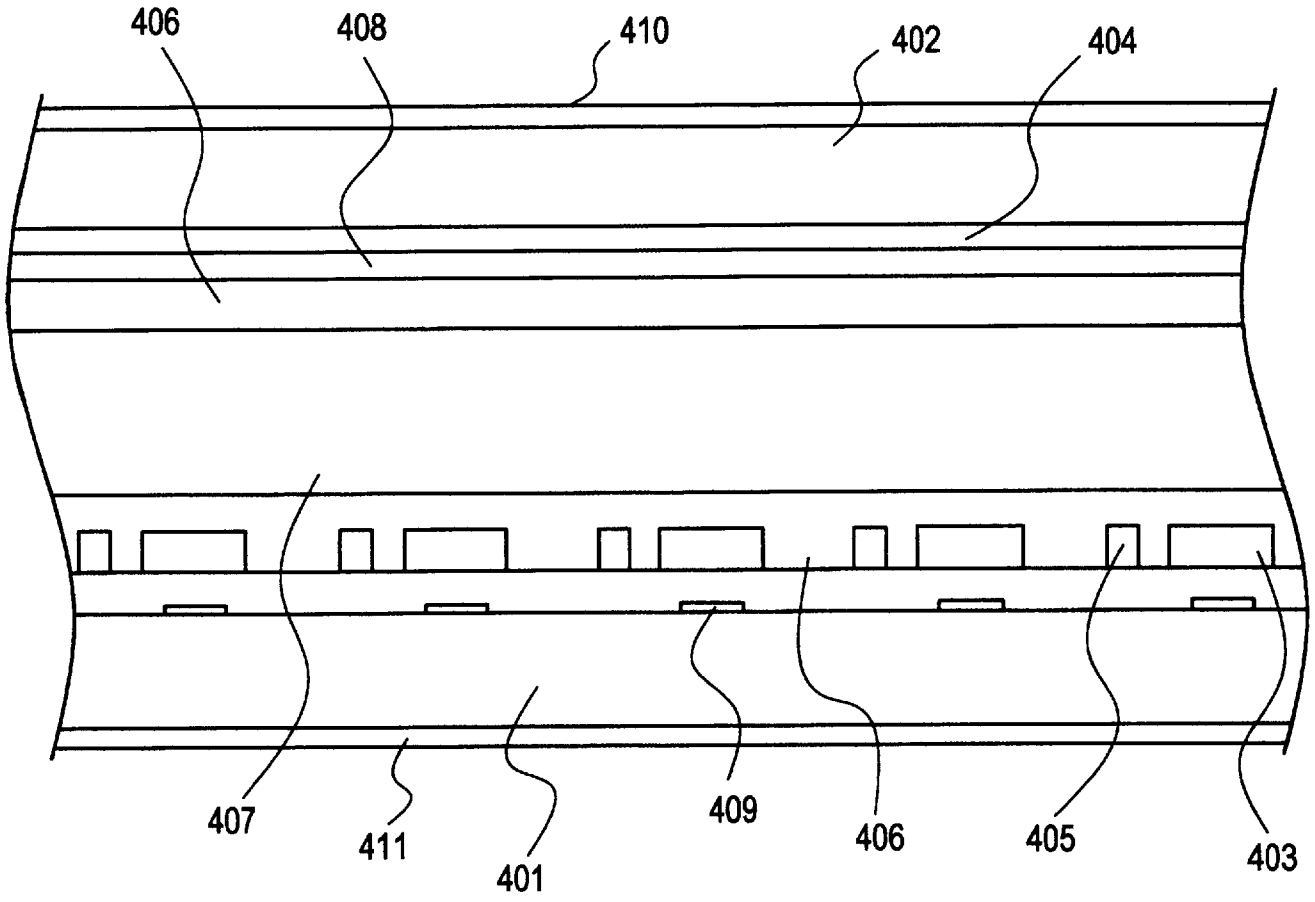
FIG. 4 shows a configuration of a liquid crystal electro-optical device according to the embodiment.

FIG. 4 shows a configuration of a liquid crystal electro-optical device according to this embodiment. An active matrix using crystalline silicon TFTs 405 that were formed on a non-alkali glass substrate was formed on one substrate 401 of a cell. In this embodiment, auxiliary capacitors 409 were formed on the substrate 401 (see FIG. 4), because a liquid crystal material having large spontaneous polarization was used as described below. The auxiliary capacitors 409 had a capacitance of $5.4\times10^{-5}$ pF, and were provided in parallel with respective pixel capacitors. The TFTs 405 were single-gate PMOS transistors, because they can provide a small leak current and a large on/off ratio. Typical values of the leak current (gate voltage: +15 V; drain voltage: −10 V)

and the on/off ratio (gate voltage: −15 V/+15 V; drain voltage: −10 V) were less than 1 pA and more than 7.5 digits, respectively.

The other substrate 402 was formed such that an ITO film as an opposed electrode 404 was formed over the entire surface of a substrate 402 and a short-circuit preventing silicon oxide film 408 was formed thereon. Each pixel electrode 403 had a size of 20 μm×60 μm, and the matrix scale was 1,920×480.

A polymeric resin dissolved in a solvent was then coated on the substrates by spin coating to form orientation films 406. The polymeric resin was a polyimide resin (produced by Toray Industries, Inc.) and the solvent was n-methyl-2-pyrolidone. The polymeric resin was diluted by a factor of 8. The substrates coated with the polymeric resin were heated at 280° C. for 2.5 hours to dry the solvent and imidize the resin. The resin formed on the substrates was rubbed with a roller on which a cloth such as a velvet cloth is rolled, at a rotation speed of 1,000 rpm in one direction. The two substrates were joined together by pressing those against each other with inorganic spacers of 1 to 7 μm, in this embodiment, 2 μm, in size placed therebetween. A liquid crystal material 407 was injected into a space between the two substrates.

Polarizing plates 410 and 411 were provided outside the two substrates.

Next, a description will be made of the liquid crystal material 407. In this embodiment, a phenylpyrimidine type ferroelectric liquid crystal was used which has a phase series of Iso-SmA-SmC*-Cry with transition temperatures of 98.4° C. (Iso-SmA), 81.5° C. (SmA-SmC*), and 33.5° C. (SmC*-Cry). The thickness of the liquid crystal cell was made to be 1.6 μm. The spontaneous polarization of the liquid crystal material 407 was 5.0 nC/cm$^2$.

A domain structure was observed in the liquid crystal material 407 when a voltage lower than 5 V was applied thereto. Since the domain structure deteriorates the characteristics of digital gradational display, the application voltage should be set at a higher value.

In the liquid crystal electro-optical device of this embodiment, the dependence of the contrast ratio on the data signal application time was checked with a frame frequency of 60 Hz. The liquid crystal material 407 responded properly during one scan of the screen even where the width of drive pulses, i.e., data signals was 1 μsec, which was shorter than the response time (several tens of microseconds) of the liquid crystal material 407. Therefore, the width of drive pulses was set at 1 μsec in this embodiment.

(3) Example of driving

Figure 1:
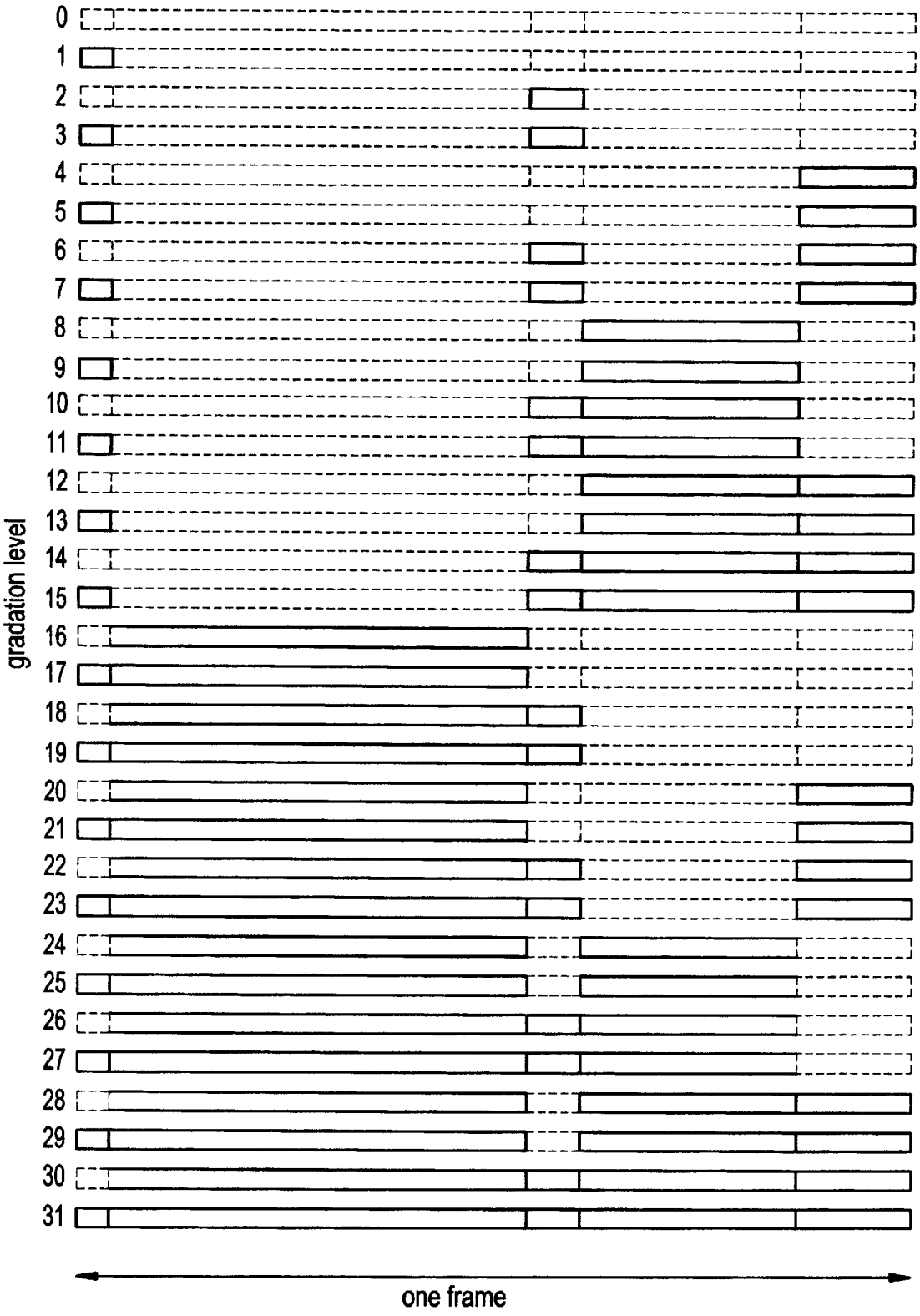
FIG. 1 shows an example of combining subframes.

Using the above driving circuit of the liquid crystal electro-optical device, digital gradational display by switching between the light and dark states was conducted. Specifically, digital gradational display of 32 gradation levels was conducted in which one frame was constituted of five subframes as shown in FIG. 1. The durations of the first to fifth subframes were 0.54 msec, 8.61 msec, 1.07 msec, 4.29 msec, and 2.15 msec, respectively. One frame period was set at 16.5 msec (60 Hz).

The scanning electrode selection period was divided into a pixel voltage detection period and a drive pulse output period. Since the response time of the operational amplifiers was shorter than 1/10 of the above periods, there occurred no problem in outputing the drive pulses. Therefore, the above-mentioned division of the selection period caused no influence on the display characteristics.

Figure 5:
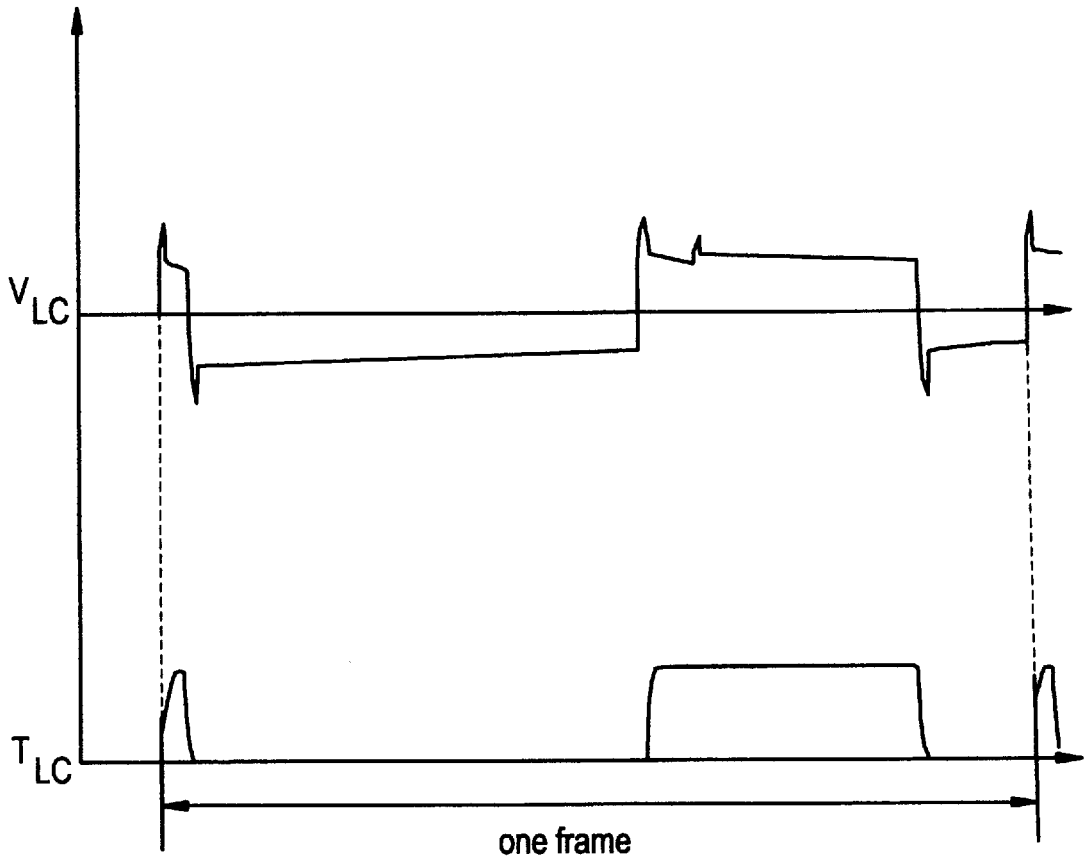
FIG. 5 shows examples of the pixel voltage and the optical response of the liquid crystal electro-optical device of the embodiment.

FIG. 5 shows examples of the pixel voltage and the optical response of the liquid crystal electro-optical device of this embodiment. As is understood from FIG. 5, both of dark-to-light switching and light-to-dark switching were effected in a definite manner.

Figure 6:
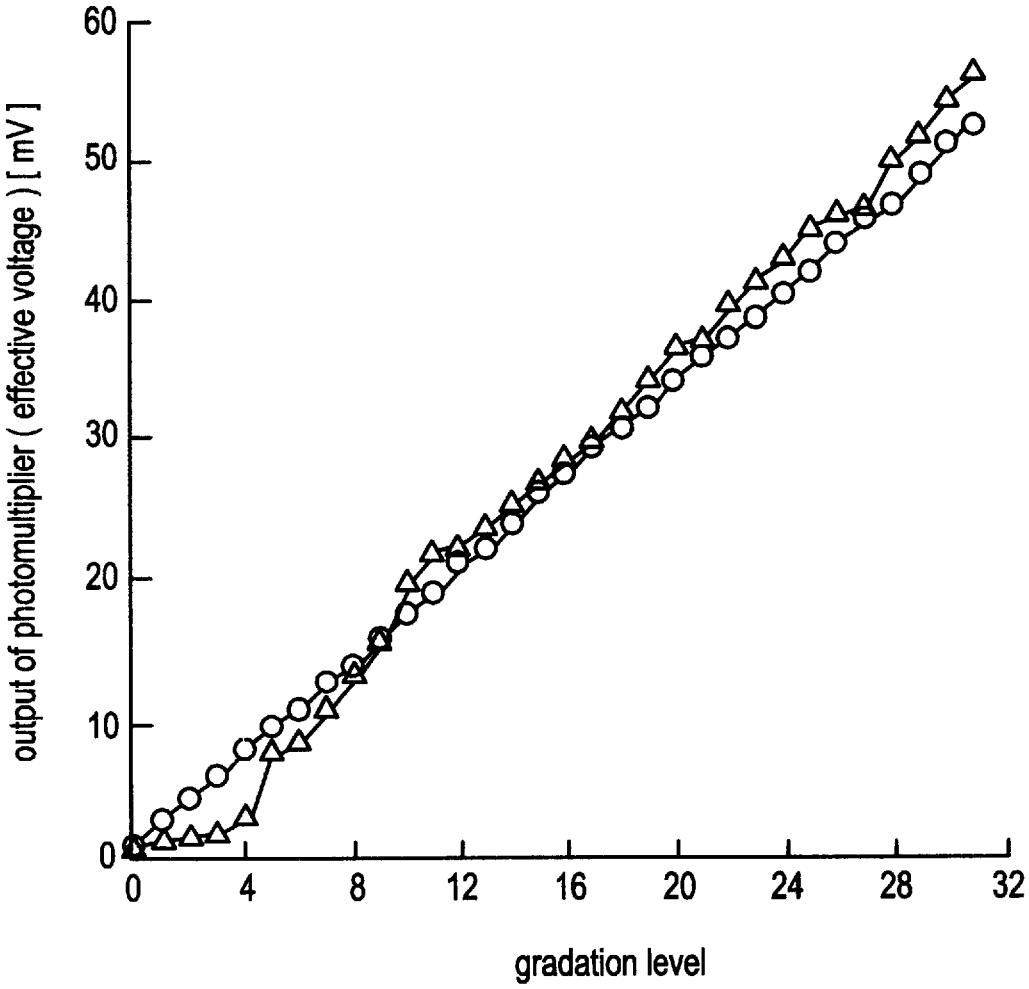
FIG. 6 shows a measurement result of optical response levels at respective gradation levels in the embodiment.

FIG. 6 shows a measurement result of optical response levels at respective gradation levels. The optical response level is an effective value of an output of a photomultiplier during one frame period. Also shown in FIG. 6 are optical response levels that were obtained with the same liquid crystal electro-optical device by the conventional driving method in which the voltage value of drive pulses was fixed at ±15 V. By employing the driving circuit having the circuit configuration of this embodiment, the linearity of gradation was improved from the case of employing the conventional driving method in which the voltage value of drive pulses is fixed.

A remaining voltage $V_{rem}$ of each frame was large enough to hold, during each subframe, the orientation state of the liquid crystal material after switching.

As described above, the invention can provide the liquid crystal electro-optical device and its driving method which can attain a desired degree of gradation in realizing gradational display by optically controlling light and dark periods in the gradational display method for obtaining halftone color or gray scale expressions in a liquid crystal display device which employs thin-film transistors as the switching elements for driving and a ferroelectric or antiferroelectric liquid crystal.

That is, the invention can realize definite optical switching even in high-speed driving, enabling very clear gradational display of a large number of gradation levels.

In the invention, the relationship between the application voltage value and the pixel voltage immediately before its application was studied, which had not been investigated conventionally. By applying a voltage that is suitable for the pixel voltage, the liquid crystal material can be driven under as good conditions as possible, realizing the high-performance liquid crystal display capable of multi-gradational display which liquid crystal display utilizes high response speed, a high contrast ratio, and a wide viewing angle of a ferroelectric liquid crystal.

While the present invention is described in the preferred embodiment of the present invention, the scope of the present invention should not be limited to the specific examples of the embodiment. Many modifications may be made by those ordinary skilled in this art. For example, although a ferroelectric liquid crystal and an antiferroelectric liquid crystal are disclosed as most suitable liquid crystals for the present invention, other liquid crystal materials may be used if desired. Also, it is possible to employ other driving methods instead of the particular driving method such as shown in FIG. 1.

What is claimed is:

1. A liquid crystal electro-optical device comprising:

a first substrate having a driving circuit formed thereon and a plurality of pixel electrodes formed thereon in a matrix form, said pixel electrodes being provided with thin-film transistors connected thereto;

a second substrate opposed to the first substrate and provided with an opposed electrode;

a ferroelectric or antiferroelectric liquid crystal material provided between the first and second substrates, a voltage applying circuit for applying a first voltage through one of the thin film transistors to the crystal material between the respective pixel electrodes and the opposed electrode; and a voltage detecting circuit for detecting said first voltage, said voltage detecting circuit feeding said first voltage back to said voltage applying circuit, wherein said voltage detecting circuit comprises at least an operational amplifier and a transistor.

2. A device according to claim 1 further comprising a storing means for temporarily storing the detected first voltage.

3. A liquid crystal electro-optical device comprising:

a first substrate having a driving circuit formed thereon and a plurality of pixel electrodes formed thereon in a matrix form, said pixel electrodes being provided with thin-film transistors connected thereto;

a second substrate opposed to the first substrate and provided with an opposed electrode; and a ferroelectric or antiferroelectric liquid crystal material provided between the first and second substrates;

a voltage applying circuit for applying a first voltage through one of the thin film transistor to the liquid crystal material between the respective pixel electrodes and the opposed electrodes; and a voltage detecting circuit for detecting said first voltage, said voltage detecting circuit feeding said first voltage back to said voltage applying circuit, wherein said voltage detecting circuit comprises at least an operational amplifier and a transistor.

4. A device according to claim 3 further comprising a storing means for temporarily storing the detected first voltage.

5. A liquid crystal electro-optical device comprising:

a first substrate having a driving circuit formed thereon and a plurality of pixel electrodes formed thereon in a matrix form, said pixel electrodes being provided with thin-film transistors connected thereto;

a second substrate opposed to the first substrate and provided with an opposed electrode;

a ferroelectric or antiferroelectric liquid crystal material provided between the first and second substrates;

a voltage detecting circuit for detecting a first voltage between a selected one of the pixel electrodes and the opposed electrode; and a voltage applying circuit for applying a second voltage corresponding to the detected first voltage to the selected pixel electrode and the opposed electrode in between, said second voltage being varied according to said first voltage and being applied through corresponding one of said thin film transistors, wherein said voltage detecting circuit comprises at least an operational amplifier and a transistor.

6. A device according to claim 5 wherein said second voltage corresponding to the detected first voltage value is smaller than and has the same polarity as the detected first voltage value when a next display state is the same as a current display state, and is larger than and has a polarity opposite to that of the detected first voltage value when the next display state is different from the current display state.

7. A device according to claim 5 further comprising a storing means for temporarily storing the detected first voltage.

8. A liquid crystal electro-optical device comprising:

a first substrate having a driving circuit and at least a pixel electrode, said pixel electrode being provided with a thin film transistor connected thereto;

a second substrate opposed to said first substrate and having an opposed electrode;

a liquid crystal layer interposed between said first and second substrates;

a signal source for supplying a signal voltage having a video information to said pixel electrode, said signal source being located over said first substrate;

a voltage varying circuit for varying said signal voltage, said voltage varying circuit being located between said signal source and said pixel electrode; and a voltage detecting circuit for detecting a currently applied voltage to said pixel electrode, wherein said signal voltage is varied according to said currently applied voltage and applied through said thin film transistor, and wherein said voltage detecting circuit comprises at least an operational amplifier and a transistor.

9. A device according to claim 8 wherein said varying circuit for varying the signal voltage comprises at least an operational amplifier and a transistor.

10. A device according to claim 8 wherein said liquid crystal layer comprises a ferroelectric liquid crystal material or an antiferroelectric liquid crystal material.

11. A device according to claim 8 wherein said voltage detecting circuit comprises:

a first circuit formed over said first substrate, said first circuit including at least an operational amplifier, a resistor, and a diode, a second circuit formed between said first circuit and said pixel electrode, said second circuit including at least an operational amplifier, a resistor, and a FET, wherein said second circuit is said voltage varying circuit.

12. A driving method of a liquid crystal electro-optical device, wherein, said liquid crystal electro-optical device comprises, a first substrate provided with a driving circuit and a plurality of pixel electrodes in a matrix form, each of said pixel electrodes being provided with a thin-film transistor, a second substrate opposed to the first substrate and provided with an opposed electrode, and a ferroelectric or antiferroelectric liquid crystal material interposed between the first and second substrates, a voltage applying circuit located over said first substrate, and a voltage detecting circuit located over said first substrate, said method comprising the steps of:

detecting a first voltage between a selected one of the pixel electrodes and the opposed electrode by said voltage detecting circuit; and applying a second voltage value corresponding to the detected first voltage value to the selected pixel electrode by said voltage applying circuit, said second voltage being applied through the thin film transistor at said selected pixel electrode, wherein said voltage detecting circuit comprises at least an operational amplifier and a transistor.

13. A method according to claim 12 wherein the second voltage value corresponding to the detected first voltage value is smaller than and has the same polarity as the detected voltage value when a next display state is the same as a current display state, and is larger than and has a polarity opposite to that of the detected first voltage value when the next display state is different from the current display state.

14. A method according to claim 12 further comprising, after the detecting step, the step of temporarily storing the detected first voltage.

15. A driving method of a liquid crystal electro-optical device, wherein, said liquid crystal electro-optical device has, a first substrate provided with a driving circuit and a plurality of pixel electrodes in a matrix form, said pixel electrode being provided with thin-film transistors connected thereto, a second substrate opposed to the first substrate and provided with an opposed electrode, a ferroelectric or antiferroelectric liquid crystal material provided between the first and second substrates, a voltage applying circuit located over said first substrate, and a voltage detecting circuit located over said first substrate, wherein one frame is constituted of a plurality of subframes, and gradational display is performed by controlling light and dark display periods of each pixel, said driving method comprising the steps of:

detecting a first voltage between a selected one of the pixel electrodes and the opposed electrode by said voltage detecting circuit; and applying a second voltage value corresponding to the detected first voltage to the selected pixel electrode by said voltage applying circuit, wherein said voltage detecting circuit comprises at least an operational amplifier and a transistor.

16. A method according to claim 15 wherein the voltage value corresponding to the detected voltage value is smaller than and has the same polarity as the detected voltage value when a next display state is the same as a current display state, and is larger than and has a polarity opposite to that of the detected voltage value when the next display state is different from the current display state.

17. A driving method according to claim 15 further comprising, after the detecting step, the step of temporarily storing the detected voltage.

18. A driving method of a liquid crystal electro-optical device, wherein, said liquid crystal electro-optical device has, a first substrate provided with a driving circuit and a plurality of pixel electrodes in a matrix form, said pixel electrode being provided with thin-film transistors connected thereto, a second substrate opposed to the first substrate and provided with an opposed electrode, a ferroelectric or antiferroelectric liquid crystal material provided between the first and second substrates, a signal source located over said first substrate, a voltage varying circuit located over said first substrate, and a voltage detecting circuit located over said first substrate, wherein a width of drive pulses is shorter than a response time of the liquid crystal material, one frame is constituted of a plurality of subframes, and gradational display is performed by controlling light and dark display periods of each pixel, said driving method comprising the steps of:

supplying a signal voltage from said signal source to said pixel electrode, detecting a currently applied voltage between a selected one of the pixel electrodes and the opposed electrode by a voltage detecting circuit; and varying said signal voltage corresponding to the detected voltage value to the selected pixel electrode by a voltage varying circuit, applying said varied signal voltage to said selected pixel electrode, wherein said varied signal voltage is applied through one of said thin film transistors and wherein said voltage detecting means comprises at least an operational amplifier and a transistor.

19. A driving method according to claim 18 wherein the voltage value corresponding to the detected voltage value is smaller than and has the same polarity as the detected voltage value when a next display state is the same as a current display state, and is larger than and has a polarity opposite to that of the detected voltage value when the next display state is different from the current display state.

20. A driving method according to claim 18 further comprising after the detecting step, the step of temporarily storing the detected voltage.

21. A method according to claim 18 wherein said voltage detecting circuit comprises, a first circuit formed over said first substrate, said first circuit including at least an operational amplifier, a resistor, and a diode, a second circuit formed between said first circuit and said pixel electrode, said second circuit including at least an operational amplifier, a resistor, and a FET, wherein said second circuit is said voltage varying circuit.

* * * * *